US008695809B2

(12) United States Patent
Sherwood et al.

(10) Patent No.: US 8,695,809 B2
(45) Date of Patent: Apr. 15, 2014

(54) RETURN DRILLING FLUID PROCESSING

(75) Inventors: Joe Sherwood, Columbus, TX (US); Greg McEwen, Bangkok (TH)

(73) Assignee: M-I LLC, Houston, TX (US)

( * ) Notice: Subject to any disclaimer, the term of this patent is extended or adjusted under 35 U.S.C. 154(b) by 1297 days.

(21) Appl. No.: 12/122,457

(22) Filed: May 16, 2008

(65) Prior Publication Data

US 2008/0283301 A1 Nov. 20, 2008

Related U.S. Application Data

(60) Provisional application No. 60/938,279, filed on May 16, 2007.

(51) Int. Cl.

| | |
|---|---|
| ***B01D 33/03*** | (2006.01) |
| ***B01D 39/10*** | (2006.01) |
| ***B01D 35/20*** | (2006.01) |
| ***B07B 1/12*** | (2006.01) |

(52) U.S. Cl.
USPC ..... 210/384; 210/388; 210/785; 210/155; 209/674; 209/680; 175/206; 175/66

(58) Field of Classification Search
None
See application file for complete search history.

(56) References Cited

U.S. PATENT DOCUMENTS

| | | | | |
|---|---|---|---|---|
| 4,192,392 A * | 3/1980 | Messines et al. | ..... | 175/66 |
| RE35,331 E * | 9/1996 | Sherman | ..... | 209/393 |
| 2002/0104806 A1* | 8/2002 | Pullman | ..... | 210/744 |

* cited by examiner

*Primary Examiner* — Krishnan S Menon
(74) *Attorney, Agent, or Firm* — Osha Liang LLP

(57) ABSTRACT

A system for processing returned drilling fluid including a flow line configured to provide a return flow of drilling fluids and at least one vibratory separator having at least one screen, wherein the vibratory separator is fluidly connected to the flow low and is configured to receive at least a partial flow of fluids and separate the flow of fluids into a primarily fluid phase and a primarily solids phase. The system further includes a dual-trough configured to receive the primarily solid phase from the at least one vibratory separator and a slurry tank configured to receive the solids phase from the trough. Additionally, a method of processing a return drilling fluid including dividing the return drilling fluid into a primarily fluids phase and a primarily solids phase with a primary separatory operation. Furthermore, directing the primarily solids phase to a dual-trough having a first trough configured to receive a relatively large solids phase, and a second trough configured to receive a relatively fine solids phase. The method also including transmitting the relatively fine solids phase to a slurry tanks and processing the relatively fine solids phase in a secondary separatory operation.

13 Claims, 8 Drawing Sheets

RETURN DRILLING FLUID PROCESSING

CROSS REFERENCE TO RELATED APPLICATIONS

This Application claims the benefit of the following application under 35 U.S.C. 119(e); U.S. Provisional Application Ser. No. 60/938,279 filed on May 16, 2007, incorporated by reference in its entirety herein.

BACKGROUND

1. Field of the Disclosure

Generally, embodiments disclosed herein relate to systems and methods for processing returned drilling fluids. More specifically, embodiments disclosed herein relate to systems and methods for processing returned drilling fluids using vibratory separators and systems for dividing a separated return drill fluid. More specifically still, embodiments disclosed herein relate to modular systems and corresponding methods for separating and dividing a returned drilling fluid into component parts for disposal and reuse.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) and the density (or its inverse, specific gravity) of the fluid used. Depending on the type and construction of the formation to be drilled, various weighting and lubrication agents are mixed into the drilling mud to obtain a desired mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

An additional purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and re-pumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down a length of the vibrating table, the fluid falls through the perforations to a reservoir below leaving the solid particulate material on the table. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

The vibratory motion of typical shakers is generated by one or more motors attached to the basket of the shaker. In such shakers, motors and actuation devices may be placed on or be integral to the basket. In typical shakers with basket mounted motors, screens and/or screen assemblies are attached to the shaker underneath the motors. The motion of the basket is transferred to the screens, such that as drilling fluid containing solid particles passes thereover, the fluid and fine solid matter passes through the screens while relatively larger solids remain on the screen surface. The solids are typically then transferred from the shaker to either a secondary separatory operation, or otherwise disposed of according to local rules and regulations.

However, in certain cleaning operations, the shakers may have multiple separatory surfaces including, for example, multiple screening surfaces and/or screens having filtering elements of different perforation size. In some shakers a first, large perforation screening surface (i.e., a scalping deck) is placed above a second, relatively smaller perforated screen surface (i.e., a fines deck), so that large solids remain on the top screening surface. Accordingly, fines pass though the scalping deck and, when they are larger than the perforations of the filtering element of the second screen surface, collect on top of the second screen surface. The large solids and the fines may then be disposed of or used in downstream operations accordingly.

The removal of low gravity solids ("LGS") from returned drilling fluid is an important factor in an efficient drilling operation, as the presence of LGS are detrimental to the drilling process in a number of areas. If the concentration of LGS exceeds 3-5%, then a drilling process may experience a loss of rate of penetration, fluid loss, and loss of fluid viscosity.

Accordingly, there exists a continuing need for a method of processing a return drilling fluid that may efficiently clean a drilling fluid to allow for recycling of the fluid, as well as disposal of cuttings. Additionally, there exists a need for a system for processing return drilling fluid that may decrease the costs associated with controlling LGS and drilling fluid additive consumption.

SUMMARY OF THE DISCLOSURE

In one aspect, embodiments of the present disclosure include a system for processing returned drilling fluid including a flow line configured to provide a return flow of drilling fluids and at least one vibratory separator having at least one screen, wherein the vibratory separator is fluidly connected to the flow low and is configured to receive at least a partial flow of fluids and separate the flow of fluids into a primarily fluid phase and a primarily solids phase. The system further includes a dual-trough configured to receive the primarily solid phase from the at least one vibratory separator and a slurry tank configured to receive the solids phase from the trough.

In another aspect, embodiments of the present disclosure include a method of processing a return drilling fluid including dividing the return drilling fluid into a primarily fluids phase and a primarily solids phase with a primary separatory operation. Furthermore, directing the primarily solids phase to a dual-trough having a first trough configured to receive a relatively large solids phase, and a second trough configured to receive a relatively fine solids phase. The method also including transmitting the relatively fine solids phase to a slurry tanks and processing the relatively fine solids phase in a secondary separatory operation.

In another aspect, embodiments of the present disclosure includes a method of processing a return drilling fluid including providing the return drilling fluid to a primary separatory operation and drying the return drilling fluid with the primary separatory operation to produce a solids phase. Furthermore, determining whether the solids phase includes a dry solids phase or a wet solids phase, and adjusting a divider panel to control the flow of solids phase to a slurry tank if the solids phase is a wet solids phase.

Other aspects and advantages of the disclosure will be apparent from the following description and the appended claims.

DETAILED DESCRIPTION

Generally, embodiments disclosed herein relate to systems and methods for processing returned drilling fluids. More specifically, embodiments disclosed herein relate to systems and methods for processing returned drilling fluids using vibratory separators and systems for dividing a separated return drilling fluid. More specifically still, embodiments disclosed herein relate to modular systems and corresponding methods for separating and dividing a returned drilling fluid into component parts for disposal and reuse.

As used herein, the term "return drilling fluids" relates to any fluids used in the drilling of well bores. Examples of return drilling fluids include water-based and/or oil-based fluids used to provide circulation downhole to remove cuttings during a drilling operation, cool and lubricate a drill bit, or otherwise provide hydrostatic pressure during drilling operations. As discussed above, return drilling fluids may also be generically referred to as drilling fluid or drilling mud.

Embodiments of the present disclosure discussed herein are generally described as would typically be found on an offshore drilling rig. Examples of rigs in which such embodiments may be used include platforms, submersibles, semi-submersibles, spars, tension line rigs, and tender assist rigs. However, those of ordinary skill in the art will appreciate that embodiments discussed herein may find particular application in spar, submersible, semi-submersible, and tender assists rigs due to the modular design of such systems. Furthermore, because the systems disclosed herein may be incorporated as modular components, they may be readily transportable, relatively easy to install, and substantially self-contained. It will be appreciated by those of ordinary skill in the art that system and methods disclosed herein may also be used in certain land-based drilling operations, and as such, the following description of offshore drilling rigs should be considered germane to all drilling rigs and/or drilling operations.

Figure 1:
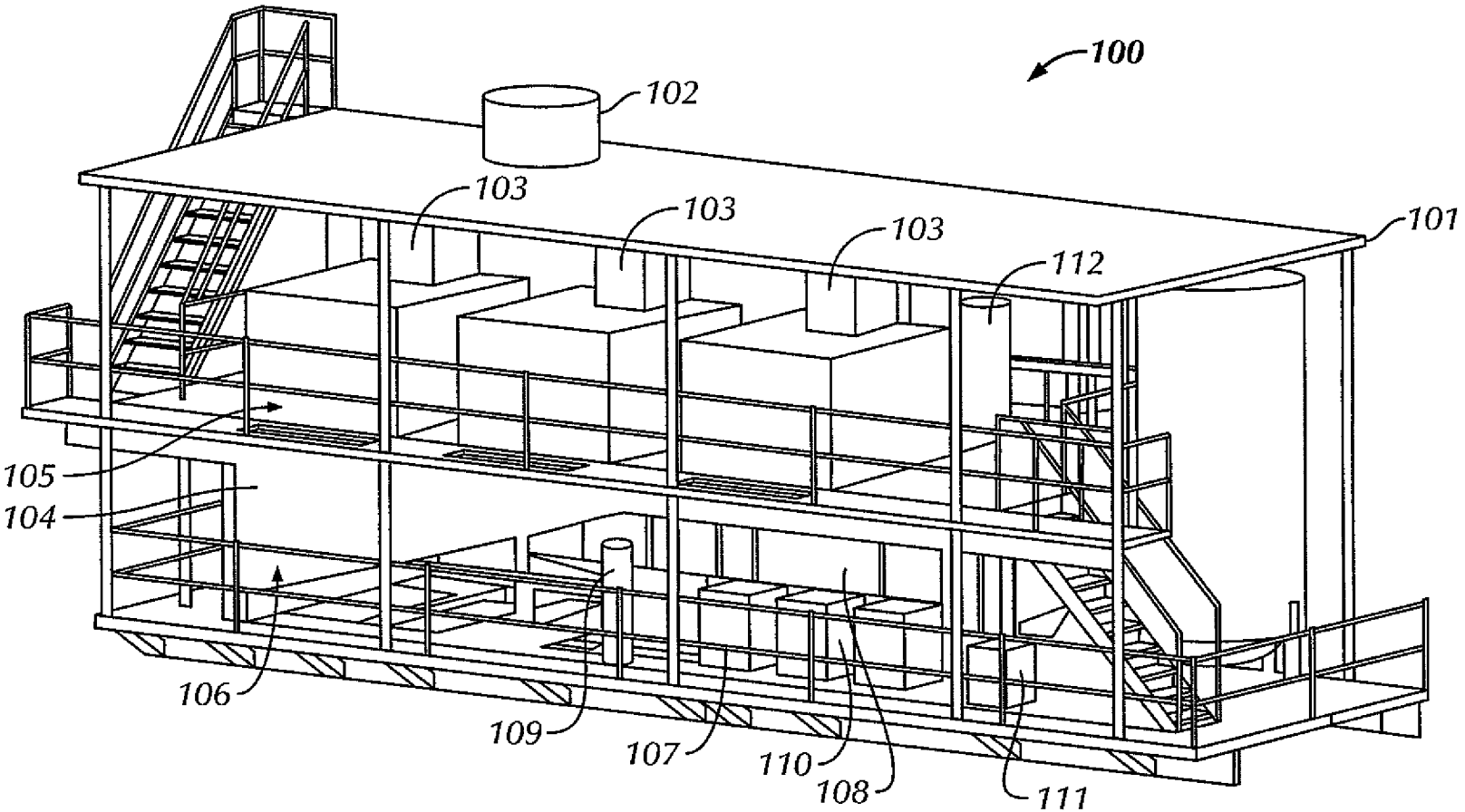
FIG. 1 shows a side perspective view of a system for processing a return drilling fluid in accordance with embodiments of the present disclosure.

Referring initially to FIG. 1, a side perspective view of a system for processing a return drilling fluid 100 according to embodiments of the present disclosure is shown. In this embodiment, system 100 is illustrated as a module system constructed and housed within a support structure 101. Support structure 101 provides, at least in part, for the modularity of the system such that system 100 may be transported from a transport vessel (not shown) to a drilling rig (not shown) with relative ease. Additionally, the modularity of the system may be further assisted, in certain aspects, by including lift points (not shown) as a part of the support structure so that cranes on transport vessels may lift system 100 onto or off of a rig.

During operation of system 100, a return drilling fluid is transmitted to a distributor box 102, which is configured to divide a flow of the return drilling fluid into a number of individual streams. The individual streams may include, for example, a return drilling fluid from a well bore having solid particulate mater entrained therein. In this embodiment, distributor box 102 accepts a flow of fluids from a well bore, in alternate embodiments, the returned drilling fluid may be conditioned prior to being transmitted to system 100. Examples of conditioning may include chemical and/or physical treatment such that primary and secondary separatory operations are more effective and/or more efficient. Those of ordinary skill in the art will appreciate that in certain embodiments wherein dividing the return fluids is not required, distributor box 102 may be replaced by a flow line (not shown). The flow line may include piping or other conduits to deliver the return drilling fluid from the wellbore to downstream equipment.

The individual streams of returned drilling fluids are then transmitted to at least one of a primary separatory operation, which as illustrated, may include one or more vibratory separators 103. While specific vibratory separators will be discussed in detail below, those of ordinary skill in the art will appreciate that any vibratory separator may be used to separate the return drilling fluid into a substantially solids phase and a substantially fluids phase. Generally, the fluids phase passes through screens (not shown) of vibratory separators 103 and into a storage reservoir or mud pit (not shown), located proximate system 100. Likewise, the solids phase generally is retained on the screens and exits vibratory separators 103 at a discharge end (not individually numbered).

In certain primary separatory operations, the substantially solids phase may be further defined as either "dry" or "wet" solids. Those of ordinary skill in the art will appreciate that "dry" or "wet" refers generally to the amount of drilling fluids remaining with the substantially solids phase during and/or after the primary separatory operation. Thus, the solids phase may be considered "wet" if a substantial quantity of fluid phase is still present after the separatory operation. Likewise, the solids phase may be considered "dry" if the cuttings do not contain a substantial quantity of fluid phase. Those of ordinary skill in the art will further appreciate that whether the primary separatory operation is run "dry" or "wet" refers to the amount of fluids remaining with the substantially solids phase, and may vary according to the type of formation being drilled, the type of drilling fluids used in the drilling operation, and the type of primary separatory operation used. Furthermore, the production of "dry" or "wet" solids phase, as well as the methods used to produce such a solids phase, may vary according to the type of separatory operation employed. As will be described below in greater detail with regard to vibratory separators, one method of producing "dry" or "wet" solids phase may include adjusting the tilt angle of a screen deck. However, those of ordinary skill in the art will appreciate that other methods of producing a desired type of substantially solids phase may include adjustment of the type of vibratory motion, the speed of the vibratory motion, additives used to clean the solids phase, as well as other methods known in the art.

After the solids phase is separated from the fluids phase, the solids are discharged from vibratory separator 103 into a trough 104 (e.g., an overboard (discard) trough). Trough 104 directs solid waste (e.g., screen overs) to either a discard location, cuttings containment, or vessels for storage. The solids may either be discarded or held for further remediation. When the operation is being run wet, relatively larger solids from, for example a scalping deck of a vibratory separator may be discarded into the overboard trough, while relatively finer solids, for example solids from a fines deck of a vibratory separator may be retained with residual fluids as a slurry. Retention of the slurry may occur by directing the relatively finer solids phase into a partition of trough 104, or into a secondary trough 104. The relatively finer solids phase trough may be used as a holding tank while the slurry consistency is adjusted, or may be used to direct the relatively finer solids phase to downstream processing equipment (e.g., storage vessels, secondary separatory operations, or injection operations). As illustrated, trough 104 may include an angled structure running in length to collect a discharge of solids phase from all of vibratory separators 103. Those of ordinary skill in the art will appreciate that the exact size and geometry of trough 104 may vary according to design constraints of a drilling operation or rig. However, generally, trough 104 may be angled to facilitate the flow of a solid from a high portion 105 to a low portion 106. Thus, the flow of the solids phase through trough 104 may be assisted by gravity. Those of ordinary skill in the art will appreciate that trough 104, including both the overboard partition and slurry partition, may be formed to any geometry, such as, for example a "V" design, an angled design, a slanted design, or any other design that may promote the flow of solids and/or fluids therethrough. In certain embodiments, the flow of solids phase through trough 104 may be further assisted by inclusion of a circulation pump 107.

Circulation pump 107 may include any pump used to circulate a fluid through a system known to those of ordinary skill in the art including, for example, an air diaphragm pump. Circulation pump 107 may be configured to provide a flow of a washing fluid from a storage tank 108 to trough 104 via a fluid line (not illustrated). In other embodiments, circulation pump 107 may be configured to provide a flow of a washing fluid from secondary holding tanks (not illustrated), active tanks (not illustrated), or a washing fluid reservoir (not illustrated). The washing fluid may include fresh water, sea water, brine solution, a slurry, recycled drilling fluids, base oil, whole mud, or other fluids that may facilitate the flow of solids though trough 104. The specific composition of washing fluid may vary depending on the type of drilling fluid used for the drilling operation, however, those of ordinary skill in the art will appreciate that the amount of washing fluid added may preferably be regulated. The regulation of the washing fluid may include measuring the amount of fluid added to the system, determining a viscosity of the slurry exiting trough 104 after the addition of the washing fluid, or using slurry of a known solids concentration. Additionally, in certain embodiments, the solids phase may be sufficiently "wet" such that addition of washing fluid is not required. In such operations, a drilling operator may still choose to wash trough 104 periodically to prevent the accumulation of solids that may otherwise inhibit the transmittance of solids phase therethrough.

Additionally, in certain embodiments, the flow of washing fluids though trough 104 and circulation pump 107 may be substantially continuous. In such an embodiments, a known volume of washing fluid may be pumped over the solids phase in trough 104 during a known time interval. As such, a substantially continuous flow of washing fluid and solids phase may mix in trough 104 to produce a slurry. In one embodiment, the slurry may then be stored in a slurry tank 109 and used to continuously wash trough 104. Such an embodiment may have the additional benefit of producing a relatively stable concentration of solids phase. However, even if the ratio of solids phase to fluids phase was not stable, additional water/oil could be added through pumping means (not shown) to produce a slurry of a desired solids content.

After the solids phase is washed from trough 104, the solids phase is transferred to slurry tank 109. Slurry tank 109 may be in fluid communication with additional tanks (not shown), circulation pump 107, a transfer pump 110, backup pumps 111, degassers 112, or other components of system 100 as required for a specific drilling operation.

In this embodiment, the slurry of solids phase and/or added washing fluid may be stored in slurry tank 109. In one aspect, circulation pump 107 may be configured to agitate the slurry inside slurry tank 109 such as to provide minimal settling of the solids in slurry tank 109. In another aspect, the agitation may occur via mechanical manipulation (e.g., stir rods) or aeration. Those of ordinary skill in the art will appreciate that the solids phase in slurry tank 109 should generally remain in motion so that exit lines, transfer line, or components of slurry tank 109 do not become clogged due to a settled out solids phase.

Figure 2:
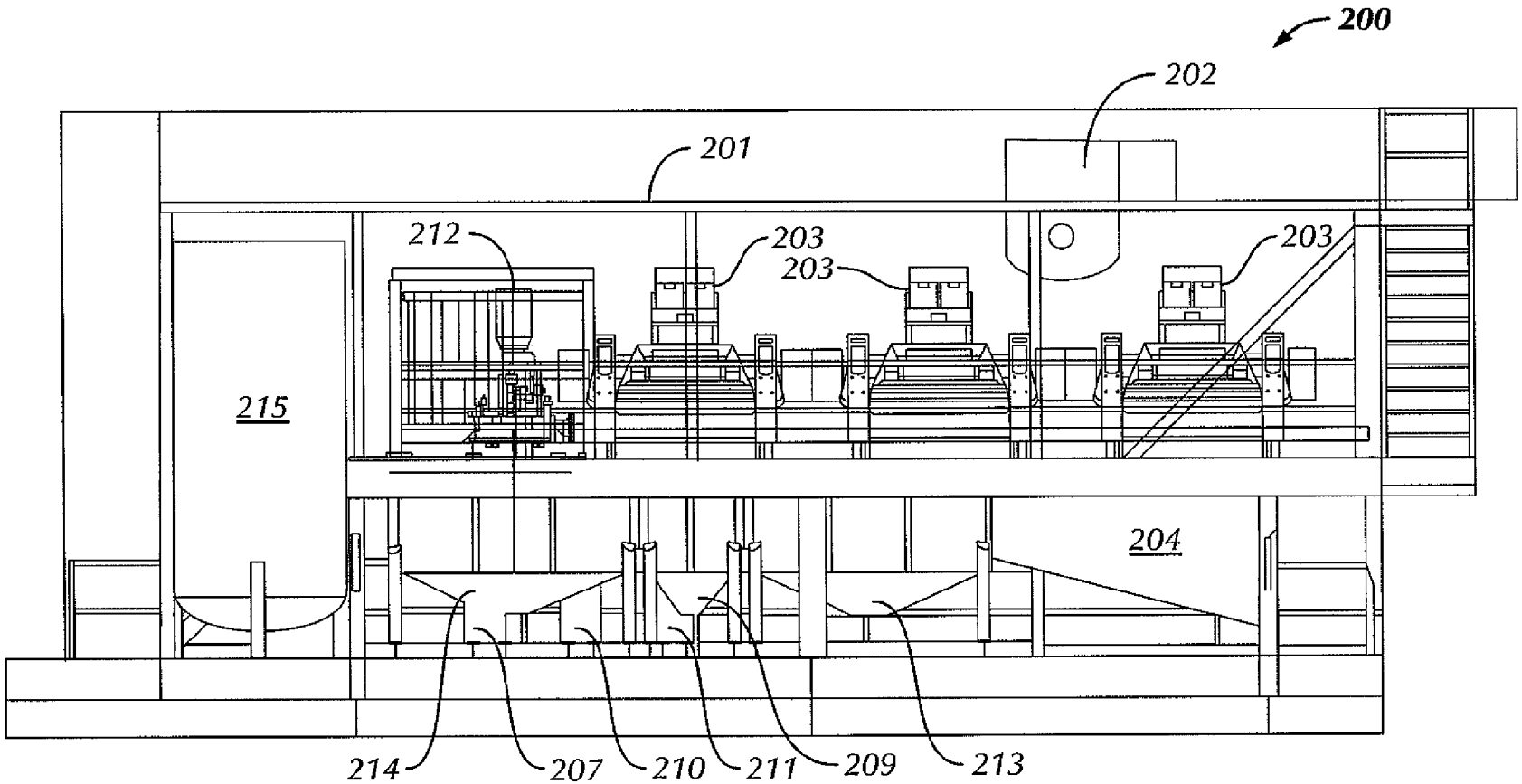
FIG. 2 shows a back side perspective view of a system for processing a return drilling fluid in accordance with embodiments of the present disclosure.

Now referring to FIG. 2, a back view of a system 200 (system 100 from FIG. 1) according to embodiments of the present disclosure is shown. In this embodiment, system 200 includes the same components as system 100 of FIG. 1. Specifically, system 200 includes a support structure 201, a distributor box 202, and three vibratory separators 203. System 200 also includes a trough 204, a circulation pump 207, a transfer pump 210, and a slurry tank 209. However, system 200, from this view, also includes a primary storage tank 213 configured to receive an initial flow of solids phase from trough 204 having a relatively finer solids phase partition. Primary storage tank 213 is disposed in fluid communication with slurry tank 209, and as such, may be used to regulate a solids phase to fluids phase ratio, as described above, or may otherwise be used to regulate a flow of solids phase from trough 204 to slurry tank 209. Those of ordinary skill in the art will appreciate that primary tank 213 may be any storage tank used in drilling operations, and in certain embodiments, may be an open pit on the drilling rig.

System 200 may also include a degasser 212, disposed proximate vibratory separators 203. Degasser 212 is in fluid communication with a degasser tank 214 and may thereby receive a return drilling fluid from, for example, vibratory separators 203 or distributor box 202, or in certain embodiments, may receive a flow of slurry or drilling fluids from primary storage tank 213 or slurry tank 209. Those of ordinary skill in the art will appreciate that in certain embodiments inclusion of degasser 212, and thus degasser tank 214, may not be necessary for operation of system 200.

Furthermore, system 200 includes a trip tank 215 that may be used to regulate a hydrostatic pressure in the well bore during trips of the drill string. Trip tank 215 may also assist in the detection of a "kick," such as when formation pressure is greater than hydrostatic head pressure, and the pressure pusses mud out of the wellbore. Trip tank 215 may include a tank with a capacity of, for example, 10 to 15 barrels, and may be used to determine the amount of drilling fluid necessary to keep the well bore substantially full of fluid during a trip of the drill string. When the drill bit comes out of the hole, a volume of drilling fluid equal to that of which the drill pipe occupied while in the hole must be pumped into the hole to replace the pipe. When the bit goes back in the hole, the drill pipe displaces a certain amount of drilling fluid, and trip tank 215 may thus be used to determine the volume of displaced drilling fluid. Fluid from trip tank 215 may be injected into the wellbore via a pump (e.g., a centrifugal pump) (not illustrated).

As illustrated, trip tank 215 may be a relatively tall cylindrical tank. Such a geometry may be beneficial in that the amount of drilling fluid pumped into the well bore may be more accurately measured and/or recorded. However, those of ordinary skill in the art will appreciate that any geometry tank may be used as trip tank 215, and in certain embodiments, trip tank 215 may not be included as a part of system 200. In systems that include trip tank 215, the tank may be in fluid communication with one or more components of system 200, such as, for example, slurry tank 209, primary tank 213, degasser 212, degasser tank 214, or one or more of pumps 207, 210, or 211.

Those of ordinary skill in the art will appreciate that the components of systems 100 and 200 may be fluidly connected via piping, tubing, troughs, or transfer lines, so long as the required fluids and gases may be transferred between the requisite components. Thus, in certain embodiment, fluid communication may include direct communication of one component with a second component. However, in alternate embodiments, fluid communication may include communication through one or more intermediary components, through transfer lines, or through structure capable of carrying the necessary media/material.

Figure 3:
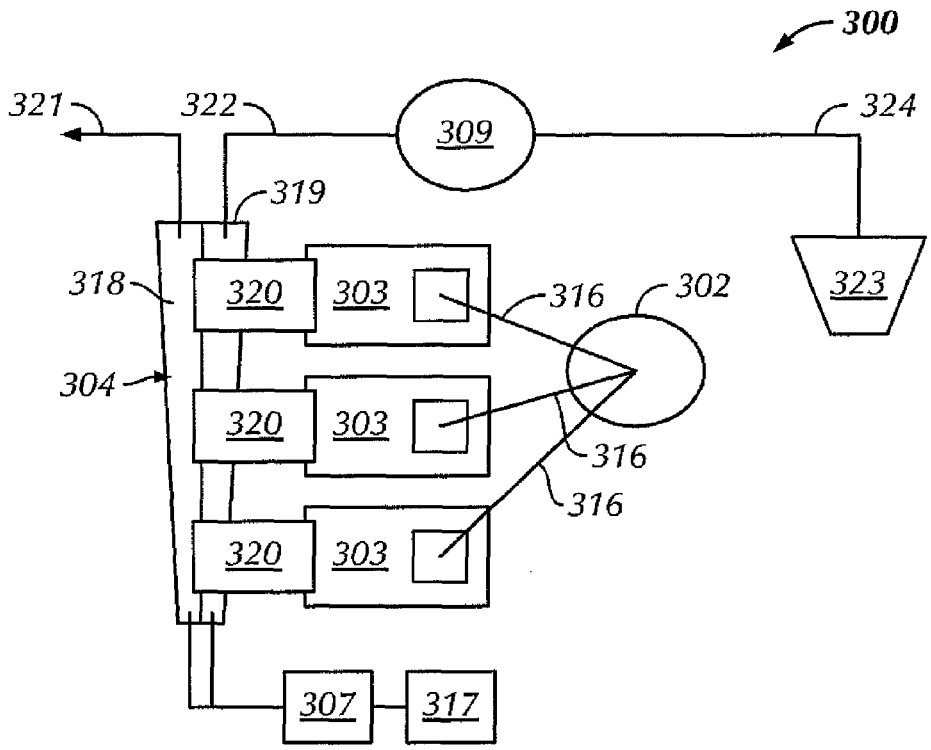
FIG. 3 shows a top schematic view of a system for processing a return drilling fluid in accordance with embodiments of the present disclosure.

Referring now to FIG. 3, a schematic top view of a system 300 according to embodiments of the present disclosure is shown. System 300 includes a distributor box 302, three vibratory separators 303, and a trough 304. System 300 also includes a circulation pump 307 and a slurry tank 309.

In this embodiment, distributor box 302 receives an inflow of return drilling fluids and distributes the fluids to vibratory separators 303 via a plurality of distribution lines 316. Distribution lines 316 may include any type of conduit capable of providing fluid communication between distributor box 302 and vibratory separators 303. Examples of distribution lines 316 may include piping, conveyors, auger systems, pneumatic systems, vacuum systems, or other means of transferring return drilling fluids known in the art. Additionally, distribution lines 316 and distributor box 302 may include flow restricting components such as, for example, valves, to control a flow of the return drilling fluid into vibratory separators 303.

System 300 also includes a backup pump 317 disposed in fluid communication with trough 304. Backup pump 317 may include an air diaphragm pump, or any other pump known in the art for transmitting a fluid in a drilling operation. Backup pump 317 may be used as an auxiliary pump for providing additional fluid/slurry flow to trough 304, may be used to provide a discrete flow of fluids to trough 304, or may be used in place of circulation pump 307.

As a solids phase is separated from the return drilling fluid in vibratory separators 303, the solids phase exits vibratory separators 303 into trough 304, wherein trough may include a plurality of partitions therein. In one aspect of the present disclosure, trough 304 is a dual-trough system including a large solids partition 318 and a fine solids partition 319. A plurality of divider panels 320 are disposed between trough 304 and vibratory separators 303 for controlling a flow of solids phase therebetween. In certain embodiments, divider panels 320 may include diverters, classifiers, or other components to direct a flow of solids within system 300. In alternate aspects of the present disclosure, divider panels 320 may be located as an integral feature of trough 304, such that a flow of solids phase is diverted internal to trough 304. In this embodiment, diverter panels 320 are configured to divert a flow of solids phase from vibratory separator 303 to large solids partition 318. However, those of ordinary skill in the art will appreciate that by actuating diverter panels 320, the flow of solids phase may be diverted to fine solids partition 320. Such actuation may occur by manually moving diverter panels 320 through use of a lever system, a pneumatic actuator, or through other methods as known in the art. Additionally, those of ordinary skill in the art will appreciate that diverter panels 320 may be formed from any material known in the art such as, for example, metal alloys and/or stainless steel. However, in certain embodiments, it may be preferable that diverter panels 320 be manufactured from corrosion resistant materials capable of withstanding the abrasive effects of drilling fluids and drilling waste.

In this embodiment, as configured, the relatively large solids phase flow across/through diverter panels 320 into large partition 318. The large solids then flow through large partition 318 of trough 304 where they may exit system 300 via a discharge port 321. In certain aspects, discharge port 321 may be configured to couple to a solids collection vessel (not illustrated) such as cuttings boxes, vacuum assist systems, or pneumatic conveyance systems. However, in certain operations, as determined by the regulations at a drilling location, discharge port 321 may facilitate the conveyance of the solids phase off of a rig, where the cuttings may be discharged overboard.

In another aspect of the present disclosure, diverter panels 320 may be actuated to provide a flow of solids phase to fine solids partition 319. Fine solids partition 319 of trough 304 may then facilitate the conveyance of the wet solids phase into slurry tank 309 via a transfer line 322 providing fluid communication therebetween. Because the wet solids phase may have a propensity for caking in trough 304 or otherwise becoming difficult to transfer through trough 304, circulation pump 307 may be configured to provide a flow of washing fluids to trough 304. As illustrated, circulation pump 307 may be used to convey a flow of fluids to both large solids partition 318 and/or fine solids partition 319. The fluid, which may be solids laden, may be diluted with a base fluid, water, whole mud, or washing fluid to a desired consistency, and pumped to additional downstream equipment, as described above. Those of ordinary skill in the art will appreciate that it may be preferable to only use a slurry as the washing fluid in fine solids partition 319. By using a slurry from, for example slurry tank 309, as the washing fluid, a rate of solids addition to slurry tank 309 may be controlled. Furthermore, a concentration of fines in the slurry may be controlled by regulating a flow of washing fluids into trough 304. For example, if the solids-to-fluids ratio in slurry tank 309 is too high, additional fluids may be added via circulation pump 307 to dilute the slurry. Likewise, if the solids-to-fluids ratio in slurry tank 309 is too low, the flow of fluids may be slowed down, or otherwise the addition of fluids may be stopped for a specified time interval. In still other embodiments, if the solids-to-fluids ratio in slurry tank 309 is too low, a circulation process may be used to transmit a slurry from slurry tank 309 to trough 304. In such an embodiment, the addition of fines may continue, while the fluid used as a washing fluid is the slurry from slurry tank 309. Such a circulation process may be continued until a desirable solids-to-fluids ratio is achieved. The determination of a desired solids-to-fluids ratio of the slurry in slurry tank 309 will vary according to the requirements of a given drilling operation.

After a slurry is formed in slurry tank 309, the slurry may be transferred to a secondary separatory operation 323. Secondary separatory operations 323 may include further vibratory separators, centrifuges, hydrocyclones, retention tanks, or other means of separating solids from fluids known in the art. Those of ordinary skill in the art will appreciate that the solids phase in slurry tank 309 will generally consist of fines. As such, appropriate separatory means in certain drilling operations may be restricted to fines separation devices. Specific secondary separatory operations 323 that may be applicable will be discussed below in greater detail.

In one embodiment, secondary separatory operation 323 may be located on a transport vessel, such as, for example, a tender-assist barge. In such an embodiment, the flow of slurry between slurry tank 309 and secondary separatory operation 323 may be via a tender line 324 providing fluid communication therebetween. Those of ordinary skill in the art will appreciate that the transportation of the slurry between slurry tank 309 and secondary separatory operation 323 may include a substantially continuous flow. However, in alternate embodiments, the flow of fluids may be controlled and/or assisted by valves (not shown) and additional pumps (not shown). As such, a desired flow rate of the slurry between slurry tank 309 and secondary separatory operation 323 may be obtained. Furthermore, the flow of slurry between slurry tank 309 and secondary separatory operation 323 may not be direct. For example, the slurry may exit tender line 324 into an intermediate process tank (not shown) either located on the rig or on the transport vessel. In such an embodiment, the slurry may then be stored in the process tank until the drilling operator decides to commence secondary separatory operation 323.

Figure 4:
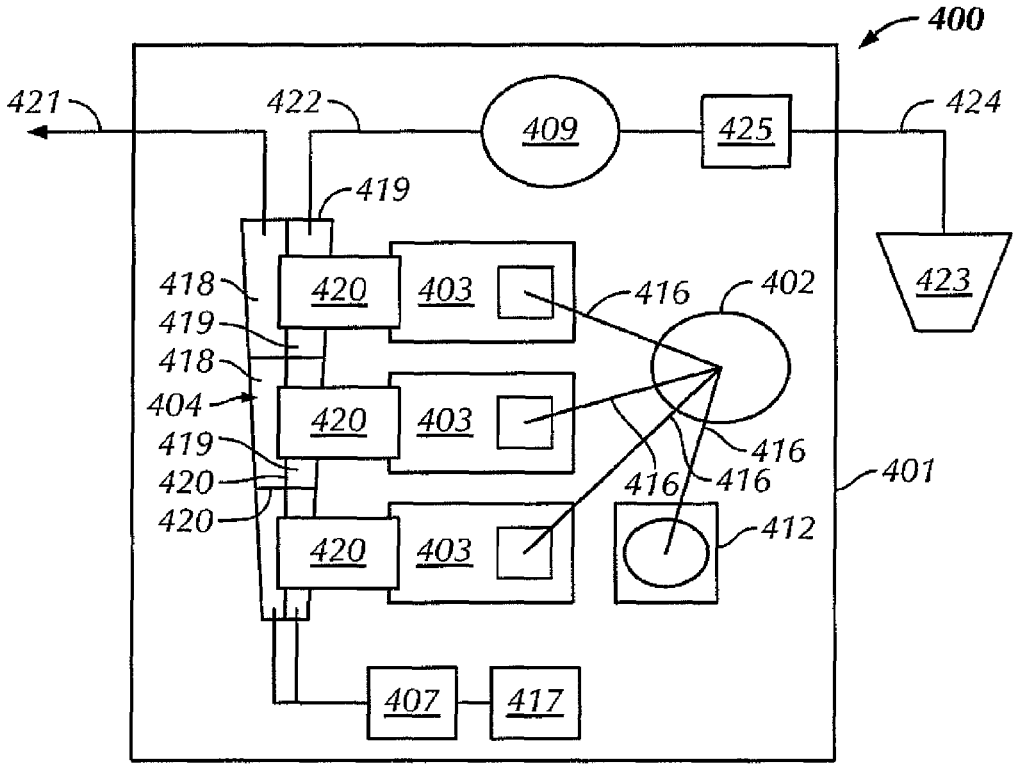
FIG. 4 shows a top schematic view of a system for processing a return drilling fluid in accordance with embodiments of the present disclosure.

Referring now to FIG. 4, a schematic top view of a system 400 according to embodiments of the present disclosure is shown. System 400 includes a distributor box 402, three vibratory separators 403, and a trough 404. System 400 also includes a circulation pump 407 and a slurry tank 409. In this embodiment, system 400 is similar to system 300 of FIG. 3, with the addition of specific components that may be used in the processing of return drilling fluids. System 400 is modularized within a support structure 401, which may include a housing, as described above. Support structure 401 may also include components such as protrusions to assist in crane lifts, when system 400 is used in specific drilling operation such as, for example, on a tender-assist rig.

In operation, a return drilling fluid is transmitted to distributor box 402, where the drilling fluid is divided into separate flows to individual vibratory separators 403 and/or a degasser 412 via distribution lines 416. In certain embodiments, degasser 412 may also be connected to one or more of vibratory separators 403, slurry tank 409, or another holding vessel used with system 400. As such, degasser 412 may be operatively used at the discretion of the drilling operator to remove gasses from the return drilling fluid.

As described with respect to FIG. 3, after a solids phase is separated from the return drilling fluid, the solids phase is transmitted to trough 404 via diverter panels 420. Diverter panels 420 may thus be used to control the flow of solids phase into trough 404. However, in this embodiment, trough 404 includes internal diverter panels 420 to further control the flow of solids through trough 404. Internal diverter panels 420 may include a plurality of panels that effectively partitions trough 404 into sections. Those of ordinary skill in the art will appreciate that diverter panels 420 may include, for example movable plates, gates, or baffles. Furthermore, diverter panels 420 may be used to restrict or otherwise control a flow of solids through trough 404, and may be used to control or sectionalize a large solids partition 418 from a fine solids partition 419.

After the solids phase is divided into a dry solids phase and a fines solids phase, the dry solids phase may exit system 400 via a discharge port 421. Wet solids phase may be diverted though a transfer line 422 to slurry tank 409. The slurry of fines and fluids may be assisted through trough 404 or through discharge port 421 via use of a circulation pump 407 and/or a backup pump 417 as described above. In one embodiment, circulation pump 407 may be configured to provide a flow of slurry from slurry tank 409 to fine solids partition 419 of trough 404 while backup pump 417 is configured to provide a separate flow of a fluid to large solids partition 418. Those of ordinary skill in the art will appreciate that the flow of fluids may vary depending on the requirements of specific operations. For example, in one embodiment, the washing fluid pumped into fine solids partition 419 may be a slurry from slurry tank 409, while the washing fluid pumped into large solids partition 418 may be seawater. In alternate embodiments, the specifics of washing fluid, and they types of washing fluids used may vary according to the specific requirements of the drilling operation. As such, specifics of the washing fluid are not meant as a limitation of the present disclosure.

After the slurry is transferred via transfer line 422 to slurry tank 409, a slurry pump 425 may be used to transfer the slurry to a secondary separatory operation 423 via a tender line 424, or other transfer line. Slurry pump 425 may be an air diaphragm pump, or other pump known to those of skill in the art used to transfer slurries of drilling fluid and or drilling waste. As described above, secondary separatory operation 423 may be located proximate system 400, be integral to system 400, or be located off the rig on, for example, a transport vessel.

In certain embodiment, a modular system may include a dual-trough 404 and slurry tank 409. In such an embodiment, the modular system may include a hanging or cantilevered module configured to process drilling fluids from a wellbore. The drilling fluids may first pass through a primary separatory operation, such as one or more vibratory separators 403, and the liquid phase passing therethrough may enter the modular system via an underflow for the primary separatory operation. Such a modular system including dual trough 404 and slurry tank 409 may include additional components, such as a centrifuge, a vibratory separator, a slurry pump, a circulation pump, a distributor box, a divider panel, and a filtering element.

To farther explain design parameters of the above described systems, individual components will be described in detail below.

Primary Separatory Operation

Primary separatory operations used on drilling rigs typically include drying cuttings and separating a solids phase of a drilling fluid from a fluids phase through the use of vibratory separators. Many designs of vibratory separators are known in the art including single-deck, dual-deck, doubles, triples, cascading, and side-by-side. As described above, a returned drilling fluid is transmitted to a screening surface of the vibratory separator, where motion from a vibrating screen is applied to the drilling fluid. The motion from the vibrating screen sheers the drilling fluid, and a solids phase is separated from a fluids phase. The particle size of the solids phase that remains on the screen is determined based on the perforation size of a filtering element disposed on or integral to the screen. Thus, as the perforation size of the filtering elements is increased, the minimum size of particles remaining on the screen surface is also increased.

Figure 5:
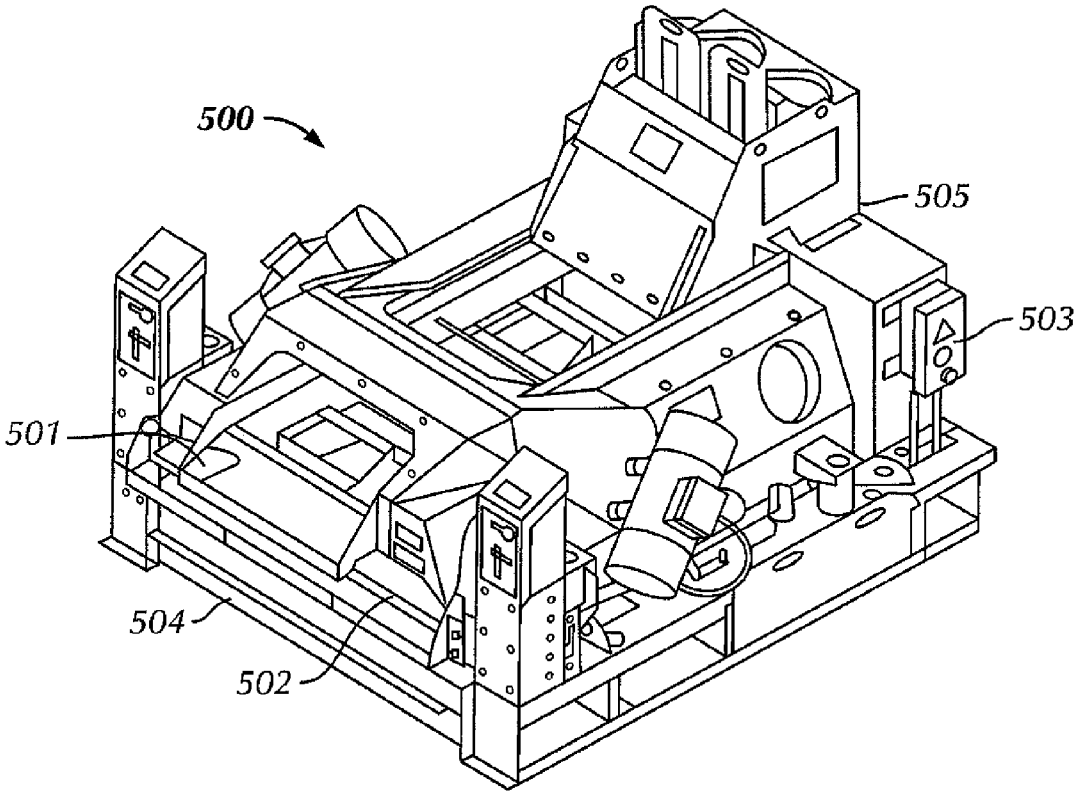
FIG. 5 shows a perspective view of a vibratory separator in accordance with embodiments of the present disclosure.

While a number of different vibratory separators are known in the art, an example of a vibratory separator that may be used according to embodiments of the present disclosure is the BEM-650, commercially available from M-I LLC, Houston, Tex. Referring to FIG. 5, vibratory separator 500 includes a first screen surface 501 (i.e., a scalping deck) and a second screen surface 502 (i.e., a fines deck). As a return drilling fluid is transmitted over first screen surface 501, a relatively dry solids phase is separated from the return drilling fluid. Second screen surface 502 may provide additional area for separating a relatively wet solids phase from the return drilling fluid.

Those of ordinary skill in the art will appreciate that first screen surface 501 and second screen surface 502 may have a plurality of screens disposed thereon. Screens used in separatory operations may embody any number of design features to enhance the separation of the solids phase from the fluids phase. Examples of design features that may enhance a screen's separation efficiency include a type of screen attachment (e.g., pretension or hook strap), a frame design (e.g., composite or metal alloy), and a filtering element size or material.

Those of ordinary skill in the art will further appreciate that due to the low return drilling fluid flow rates associated with embodiments of the present disclosure, it may be beneficial to use a screen having a relatively fine filtering element. While the specific filtering element used in a given separatory operation may vary according to the requirements of a drilling operation, examples of filtering element size that may be used with embodiments disclosed herein include filtering elements having perforations of 75 microns or less. Examples of filtering elements that may be used according to embodiments disclosed herein include XR® 325 through XR® 400 and HC 325 series filtering elements commercially available from M-I LLC, Houston, Tex. However, in certain embodiments, it may be beneficial to use a filtering element of a larger size, and as such, the filtering element perforation size is not intended to be a limitation on the scope of the present disclosure except as indicated by the claims appended hereto.

Vibratory separator 500 may also include a control panel 503 such that variables effecting the separatory operation may be controlled. Examples of variables that a drilling operator may need to adjust during the separatory operation include a type of motion used and a deck angle.

The type of motion used may be varied according to the specific requirements of the drilling operation. Examples of separatory motion may include linear, round, and elliptical. Those of ordinary skill in the art will appreciate that in certain embodiments, a specific type of motion may provide for the most efficient removal of the fluids phase from the solids phase. In one aspect, vibratory separator 500 may be configured to produce an elliptical motion. An example of a commercially available balanced-elliptical-motion vibratory separator is the BEM-650, discussed above. Aspects of the present disclosure may benefit from the use of balanced-elliptical-motion, because the motion provides a gentle rolling motion that may consistently provide optimal fluids removal and recovery while generating less screen and filtering element wear. Such consideration may be of greater importance in embodiments of the present disclosure using relatively small perforated filtering elements, as discussed above.

The tilt of the deck angle controls the speed with which cuttings may be transmitted along a deck of vibratory separator 500. As the height of a discharge portion 504 of screen surfaces 501 and 502 is increased relative to a receiving portion 505, the time drilling fluids remain on vibratory separator 505 is increased. Likewise, as receiving portion 505 height is increased relative to discharge portion 504 height, the speed of cuttings transmittance across screening surfaces 501 and 502 may be decreased. Those of ordinary skill in the art will appreciate that the adjustment of relative deck angle height is referred to as deck tilt angle. By adjusting the tilt angle of the deck, the amount of time cuttings remain on vibratory separator 500 may be adjusted. Furthermore, by adjusting the time cuttings remain on vibratory separator 500, the amount of fluid removed from the cuttings may be adjusted, and the amount of fluid carried over the separator screens with the solids may also be adjusted.

In certain embodiments, it may be beneficial to increase the amount of time cuttings remain on vibratory separator 500 such that dryer cuttings are produced. Those of ordinary skill in the art will appreciate that dryer cuttings refers to a relative quantity of fluids removed from cuttings. In one aspect, it may be beneficial to produce dryer cuttings, thereby decreasing the volume of waste to be disposed. Dryer cuttings may also have the benefit, especially when the drilling fluid is water-based, of being more readily disposed of via overboard disposal or dumping. However, in other aspects, it may be beneficial to run the vibratory separators wet. Those of ordinary skill in the art will appreciate that running the vibratory separators wet refers to decreasing the tilt angle such that more drilling fluid remains on the cuttings. Obtaining dry cuttings is the standard for most drilling operations, however, embodiments disclosed herein allow for wet cuttings to be obtained and used in subsequent aspects of the drilling operations. Those of ordinary skill in the art will appreciate that a drilling operator may switch between operating modes (i.e., the production of dry or wet cuttings) as drilling parameters of the drilling operation allow. Drilling parameters that may affect a drilling operator's decision to produce wet cuttings may include, for example, solids size, flow rates, slurry systems, and primary and secondary separatory efficiency.

Generally, it is beneficial to provide a separatory operation to produce the driest cuttings possible for a given drilling operation. However, embodiments of the present disclosure may advantageously allow a drilling operator to run a separatory operation wet, thereby taking advantage of the separatory process when making slurries and recycling drilling fluids. In one aspect, vibratory separator 500 may use screens having a filtering element perforation of 90 microns or less. In still other operations, filtering element perforations of less than 75 microns or less than 50 microns may be used. For example, in a drilling operation wherein a return flow rate of a drilling fluid from the well bore is relatively low (e.g., between 140 and 210 gallons per minute), and wherein the cuttings are relatively fine, such a small perforated filtering element may sufficiently remove LGS to allow the drilling operator to run the separatory operation wet. Thus, the relatively wet solids phase of, for example, a fines deck, may be discharged from vibratory separator 500 including a substantial volume of fluids phase.

Those of ordinary skill in the art will appreciate that in specific embodiments of the present disclosure design features of the primary separatory operation may vary according to requirements of a given drilling operation. While vibratory separators are generally the primary separatory operation, in certain embodiments, alternate separatory operation may be used prior to or with vibratory separation. Additionally, in certain embodiments, additional components may be included with or integral to the primary separatory operation. Examples of additional components may include, for example, degassers, thermal desorption devices, filter canisters, belt filters, centrifuges, hydrocyclones, or other separatory devices known in the art. Certain additional components will be discussed below for clarity, but are not meant as a limitation on the scope of the present disclosure.

Degasser

Degassers assist in maintaining a circulating fluid density so as to maintain needed hydrostatic pressure of the well fluid. A degasser applies a vacuum to a fluid and subjects the fluid to centripetal acceleration. The fluid is then sprayed against a surface, thereby removing entrained air and slowly-evolving bubbles of dissolved formation gases from the circulating fluid before its return downhole or before the fluids disposal.

Figure 6:
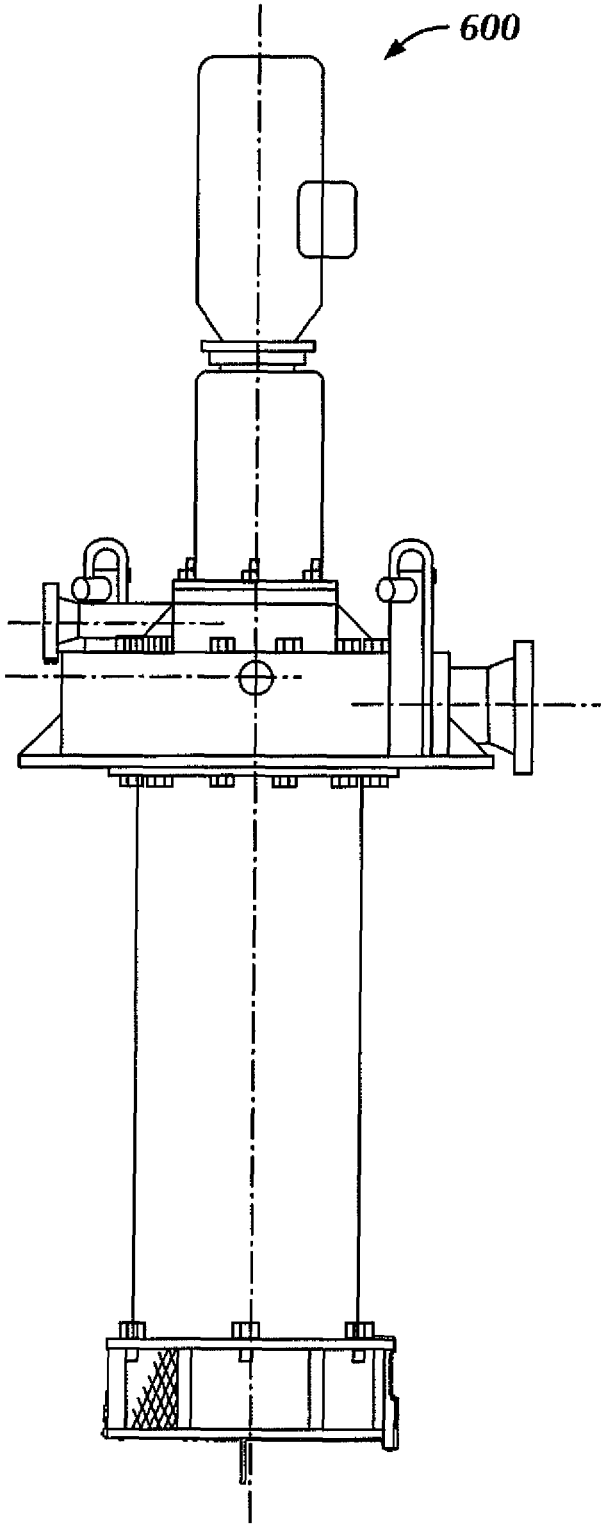
FIG. 6 shows a side view of a degasser in accordance with embodiments of the present disclosure.

Referring to FIG. 6, a mechanical degasser 600 that may be used according to embodiments of the present disclosure, is shown. One such mechanical degasser 600, may include a CD-1400 Centrifugal D-Gasser®, commercially available from M-I LLC, Houston, Tex. Mechanical degasser 600 may be coupled to a process tank (not shown). The return drilling fluid passes through mechanical degasser 600 wherein centrifugal force is exerted on the fluid. The centrifugal force of mechanical degasser 600 multiplies the force acting on the entrained gas bubbles, for example, hydrogen sulfide, to increase buoyancy of the gas bubbles, thereby releasing the entrained gas bubbles from the well fluid. The increase in buoyancy of the gas bubbles accelerates the bubble-rise velocity. As the bubbles rise toward the surface, they escape the fluid. One of ordinary skill in the art will appreciate that any device known in the art that will exert a centrifugal force on the fluid may be used in place of a mechanical degasser.

Examples of alternate degassers may include horizontal vacuum degassers, vertical vacuum degassers, and/or other degasser designs known to those of skill in the art. In certain embodiments, degassers may either not be required or not included as a part of a system of the present disclosure. As such, inclusion of a degasser in aspects of embodiments of the present disclosure is not meant as a limitation on the scope of the present disclosure.

Secondary Separatory Operation

Secondary separatory operations may be used in solids management and drilling fluid cleaning operations to further remove solids from a drilling fluid. Varied secondary separation operations may be used according to different aspects of the present disclosure such as, for example, further vibratory separation, hydrocyclones, thermal desorption, or centrifuging. According to the embodiments described above, the secondary separatory operation may include a centrifuge, such as the CD-500A, commercially available from M-I LLC, Houston, Tex. Furthermore, in certain embodiments, secondary separatory operations may include a plurality of centrifuges operating either in parallel to increase processing speed or in series to increase LGS removal.

Generally, centrifuges used according to embodiments of the present disclosure have a high-speed, precision-balanced rotating stainless steel bowl including a single-lead spiral-screw conveyor disposed inside the bowl. The conveyor rotates in the same direction as the bowl but at higher revolutions per minute ("RPM"), thereby generating a centrifugal force. A slurry of a fluid with entrained solids is fed into a hollow axle at a narrow end of the centrifuge and is distributed to the bowl. Centrifugal forces hold the slurry against the bowl wall in a pool, and trapped solids settle and spread against the bowl wall where they are scraped and conveyed to a solids underflow discharge port. Solid particles may then exit the centrifuge, while cleaned fluids exit through weirs that regulate slurry depth in the bowl.

Those of ordinary skill in the art will appreciate that the centrifugal forces generated by the centrifuge may be adjustable (e.g., between 379 g-forces at 1200 RPM to 2,066 g-forces at 2800 RPM), and thus the particle separation and solids removal may be optimized for a given drilling operation. Furthermore, centrifuges may include or be configured to include pumps to feed a slurry to the centrifuge and programmable logic controllers ("PLC") to control and allow for speed adjustments and other centrifuging parameter adjustments such as, for example, a flow rate.

Centrifuges are one type of secondary separatory operation that may be included according to embodiments of the present disclosure. Those of ordinary skill in the art will appreciate that centrifuges may be included as a part of the module described above, or placed in a different location. For example, in the embodiments discussed above, the centrifuges are located on a transport vessel docked proximate the offshore rig. In such an embodiment, a tender line may provide a slurry feed from a slurry tank located as a part of the module to a process tank or pit located on the transport vessel.

A line may then be run either directly from the slurry tank, from the process tank, from the pit, or from any other storage vessel to the centrifuge. The processed and cleaned drilling fluid may then be pumped back to the rig for injection into the well, be pumped into a trip tank located proximate the module, or otherwise stored for later use in the drilling. The removed solids may then be discarded or otherwise cleaned using tertiary cleaning operations according to methods known in the art.

Trough

Figure 7:
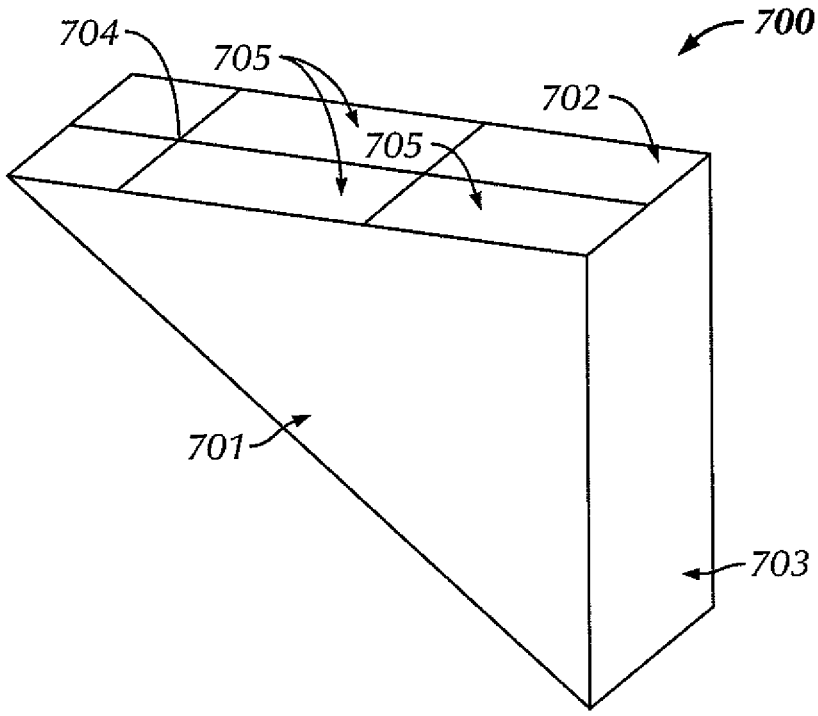
FIG. 7 shows a perspective view of a dual-trough in accordance with embodiments of the present disclosure.

The troughs used in embodiments of the present disclosure may vary in design, however, generally, the troughs should be able to either divide or facilitate the transmittance of divided solids from a primary separatory operation. Referring to FIG. 7, a dual-trough 700 according to embodiments of the present disclosure is shown. In this embodiment, dual-trough 700 includes a trough body 701 having a receiving end 702 and a discharge end 703. As such, a flow of solid phase may enter dual-trough 700 through receiving end 702, be conveyed therethrough, and exit dual-trough 700 through discharge end 703. Discharge 703 may be an open area of trough body 701, or in alternate embodiments, discharge end 703 may include a series of valves (not shown) or structures adapted to couple to piping. Furthermore, discharge end 703 may include ports (not shown) to allow for the transfer of solids, as well as to facilitate cleaning of dual-trough 700.

As illustrated in this embodiment, dual-trough 700 also includes a plurality of divider panels 704. Divider panels 704, as described above, may be used to control the flow of the solid phase through dual-trough 700. In this embodiment, divider panels 704 physically divide trough body 702 into a plurality of trough sections 705. Divider panels 704 may thus be used to control the flow of solids between individual trough sections 705. Control of divider panels 704 may occur through manually or pneumatic actuated means. For example, in one embodiment, a drilling operator may manually manipulate a lever to open one divider panel 704, such that a flow of solids is restricted from entering a portion of trough 704. Likewise, the actuation of a divider panel 704 may allow a flow of solids from entering receiving end 702, exiting from discharge end 703, or flowing between individual trough sections 705. Those of ordinary skill in the art will appreciate that the actuation of divider panels 704 may vary according to individual design consideration, but examples of divider panels may include metal plates, gates, or baffles, as discussed above.

Figure 8:
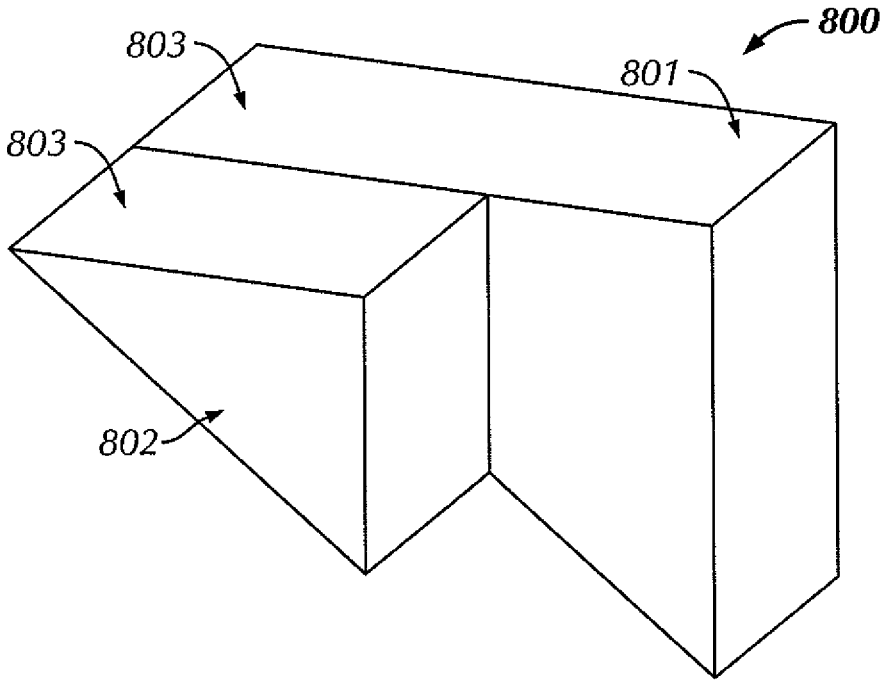
FIG. 8 shows a perspective view of a dual-trough in accordance with embodiments of the present disclosure.

Referring to FIG. 8, an alternate dual-trough 800 according to embodiments of the present disclosure is shown. In this embodiment, dual-trough 800 includes a large solids partition 801 and a fine solids partition 802. Thus, dual-trough 800 includes two structurally divided partitions, and divider panels (not shown) may provide for the separation of the solids flow prior to the solids entering trough 800. Divider panels that may be used according to aspects of this embodiment may also include divider panels 320 of FIG. 3.

In other embodiments, dual-trough 800 may include integral divider panels inside a trough body 803 of large solids partition 801 or fine solids partition 802. Such divider panels may be used, as described above regarding FIG. 7 to control the flow of solids through dual-trough 800. In still other embodiments, divider panels may be used to restrict a flow of solids through one partition, for example fine solids partition 802, while not restricting the flow of fluids through large solids partition 801. Those of ordinary skill in the art will appreciate that such an embodiment may be beneficial in systems where larger solids flow through solids partition 801 with relative ease, while fines may require a washing fluid to facilitate flow therethrough.

In certain embodiments, additional components may be included in dual-trough 800 or 700 of FIG. 7. Alternate configurations may include ports for receiving a fluid from a circulation pump, valves to control a flow of slurry, divider panels, as discussed above, or other elements to control or otherwise effect a solids phase or slurry flowing therein. Furthermore, those of ordinary skill in the art will appreciate that alternate geometric configurations of dual-trough 800 are within the scope of the present disclosure. Other configurations may include trough bodies of substantially cubic geometry, troughs with varied degrees of inclination, and dual-troughs wherein the lower section of the trough bodies are at opposite end of their respective trough bodies. As such, the designs of dual-troughs disclosed herein are exemplary, not a limitation on the scope of the disclosure.

While the above details have been specific for primary separatory operations, secondary separatory operations, and some of the components used in systems for processing drilling fluids, those of ordinary skill in the art will appreciate that certain embodiments may include additional components. Moreover, some of the components described above may be optional, and their inclusion as components of the above detailed descriptions are not a limitation on the scope of the disclosure.

Figure 9:
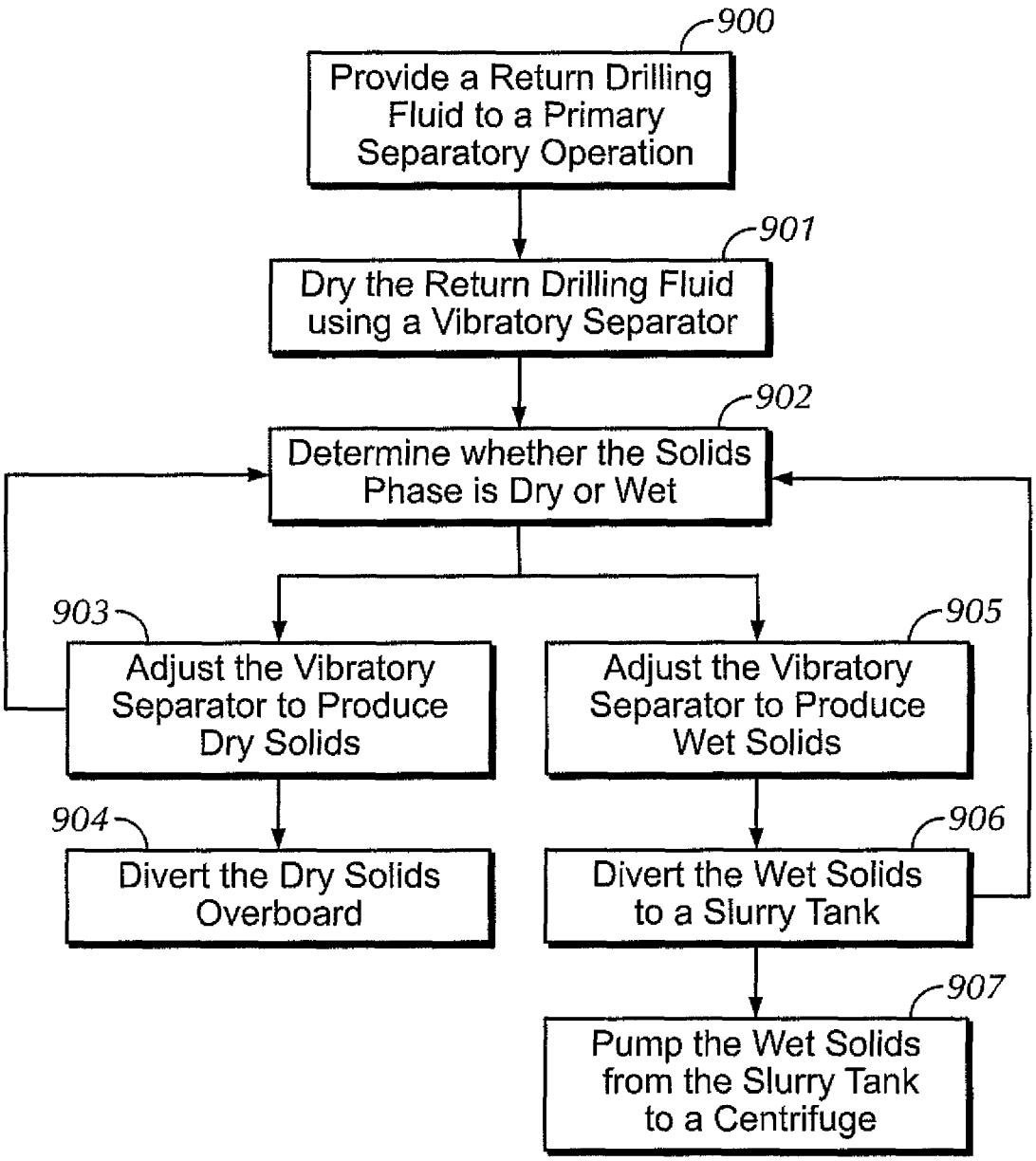
FIG. 9 shows a flowchart diagram of a method of processing a return drilling fluid in accordance with embodiments of the present disclosure.

Operation of the above described systems may benefit from additional methods of processing return drilling fluids. Referring to FIG. 9, a method of processing return drilling fluids according to embodiments of the present disclosure is shown. According to this method, a return drilling fluid is initially provided 900 to a primary separatory operation. The primary separator may include any of the devices discussed above, and in one embodiment, the primary separatory operation may include use of a vibratory separator. In this embodiment, the return drilling fluid is then dried 901 using the vibratory separator, wherein the drying 901 includes producing a solids phase and a fluids phase. Generally, the fluids phase will be recycled into the drilling system, or otherwise treated and disposed of, while the solids phase is either treated to remove additional fluids, disposed of, or saved for other operations, such as for well bore re-injection operations. In accordance with embodiments disclosed herein, in certain aspects, a drilling operator may adjust the operability of a primary separator to intentionally produce a relatively wet solids phase, and/or may add additional fluids to the separated solids phase.

In this embodiment, the drilling operator may determine 902 whether the solids phase is "dry" or "wet". Those of ordinary skill in the art will appreciate that "dry" or "wet" refers generally to the amount of drilling fluids remaining with the solids phase during and/or after the primary separatory operation. Thus, the solids phase may be considered "wet" if a substantial quantity of fluid phase is still present after the separatory operation. Likewise, the solids phase may be considered "dry" if the cuttings do not contain a substantial quantity of fluid phase. Those of ordinary skill in the art will further appreciate that whether the primary separatory operation is run "dry" or "wet" refers to the amount of fluids remaining with the solids phase, and may vary according to the type of formation being drilled, the type of drilling fluids used in the drilling operation, and the type of primary separatory operation used. Furthermore, the production of "dry" or "wet" solids phase, as well as the methods used to produce such a solids phase may vary according to the type of separatory operation employed. As described above with regard to vibratory separators, one method of producing "dry" or "wet"

solids phase may include adjusting the tilt angle of a screen deck. However, those of ordinary skill in the art will appreciate that other methods of producing a desired type of solids phase may include adjustment of the type of vibratory motion, the speed of the vibratory motion, additives used to clean the solids phase, as well as other methods known in the art.

After the drilling operator determines 902 whether the solids phase is dry or wet, adjustments to the primary separatory operation may be made to produce a desired dryness. Accordingly, in one aspect, a drilling operator may adjust 903 the vibratory separator to produce a dry solids phase. In such an aspect, the drilling operator may then choose to divert 904 the dry solids phase overboard off a rig, or otherwise collect the dry solids phase for disposal.

In alternate embodiments, the determination 902 may include the use of a resistivity sensor, or another sensing means capable of determining a relative wetness of the solids phase. In such an embodiment, the system may be adapted to divert 904 the dry solids phase overboard when a dry condition is sensed. The automation of the system may include the use of monitoring equipment, PLCs, sensors, pneumatic actuators, or other methods of automating systems known in the art.

If the drilling operator determines 902 that the solids phase being produced is wet, the drilling operator may choose to continue producing wet solids. Moreover, in certain embodiments, the drilling operator may choose to adjust 905 the vibratory separator to produce wet solids. In such an embodiment, the wet solids may then be diverted 906 to a slurry tank. Once in the slurry tank, the wet solids may then be pumped 907 from the slurry tank to a centrifuge or other secondary separatory operation for further processing. Additionally, in certain embodiments, an automated system, as described above, may determine 902 and/or adjust 905 the vibratory separator to produce and/or divert 906 the wet solids.

Those of ordinary skill in the art will appreciate that such a method of processing a return drilling fluid by producing a wet solids phase may be of particular use while drilling a formation that produces primarily fine cuttings. Additionally, the above described method may benefit from drilling conditions producing a return drilling fluid with a relatively low flow rate (e.g., a flow rate between 140 and 210 gallons per minute). In such operations where the return drilling fluid flow rate is relatively low, and the cuttings are relatively fine, fine mesh screens, as discussed above, may be used to separate out the cuttings. A drilling operator may then adjust 905 the vibratory separator to specifically produce wet solids phase, because the majority of the cuttings are being removed by the vibratory separator, and the wet solids phase may be diverted 906 to the slurry tank for further cleaning and/or recycling into the system.

One method of diverting the solids to a slurry tank may include using a divider panel, as discussed above. In such an embodiment, if the vibratory separator is producing a wet solids phase, the divider panel may be used to direct the wet solids phase into a trough that returns the fluid to a slurry tank. However, if the vibratory separator is producing a dry solids phase, the divider panels may be used to divert the dry solids phase into the trough system such that the dry solids phase are discharged from the system to either, for example, cuttings bins or overboard for disposal.

Such a method may be especially useful when the primary separatory operation includes vibratory separators having both a scalping deck and a fines deck, as described above. In such an embodiment, the solids phase from the scalping deck may be directed into the dry solids phase trough, and subsequently disposed of, while the solids on the fines deck are directed into the wet solids phase trough for recycling. The divider panels, in such an embodiment, may be used to either control the diversion of scalping deck and fines deck solids before they enter the dual-trough or once they are in the dual-trough.

Figure 10:
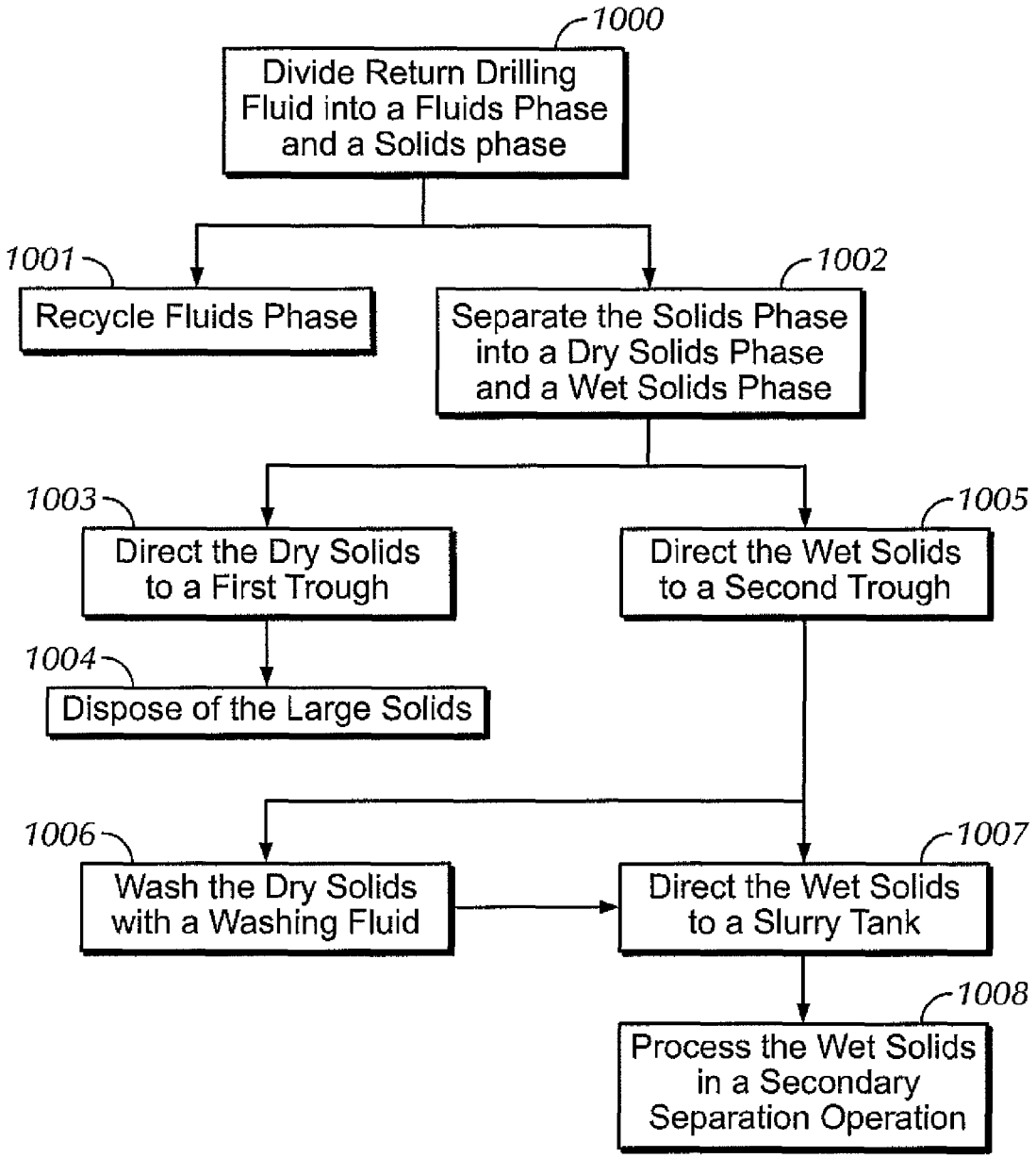
FIG. 10 shows a flowchart diagram of a method of processing a return drilling fluid in accordance with embodiments of the present disclosure.

Referring now to FIG. 10, another method of processing a return drilling fluid according to embodiments of the present disclosure is shown. Initially, the return drilling fluid is divided 1000 into a fluids phase and a solids phase by the use of a primary separatory operation such as a vibratory separator. The fluids phase may then be recycled 1001 into the drilling operation, or further treated for safe disposal. The solids phase may then be separated 1002 into a dry solids phase and a wet solids phase. One method of separation 1002 may include vibratory separators, such as the dual-deck vibratory separators described above.

After the separation 1002 of the solids phase into dry and/or wet solids phases, the dry solids are directed 1003 to a first trough. The dry solids may then be disposed 1004 of directly from the first trough. The wet solids are directed 1005 to a second trough. The division of the wet solids and the dry solids in the trough may include use of a divider panel. Thus, in one embodiment, the divider panel may prevent dry solids from entering the trough if wet solids are in the trough. Likewise, the divider panel may restrict a flow of wet solids if dry solids are in the trough. In other embodiments, a dual-trough system, as described above, may be used to allow for substantially continuous processing of both wet and dry solids.

After the wet solids are directed 1005 into the second trough, they may be washed 1006 with a washing fluid or directed 1007 into a slurry tank. While the washing of the wet solids phase is optional, those of ordinary skill in the art will appreciate that by continuously washing the wet solids phase a slurry may be formed, as described above, that may then be processed 1008 by a secondary separation operation, such as a centrifuge.

Advantageously, embodiments disclosed herein may provide systems and methods for processing a return drilling fluid that provide for cleaner drilling fluids, cleaner cuttings, and less drilling fluid additive consumption. As such, return drilling fluids may be processed and the control of LGS and the reduction of barite consumption may be improved. By decreasing barite consumption, the costs associated with drilling fluid additives may be decreased, and thus the cost of a drilling operation may be decreased.

Additionally, the methods for producing a wet solids phase disclosed herein may allow a drilling operator to more efficiently process return drilling fluids to remove cuttings therefrom. Specifically, certain embodiments may allow for the substantially continuous cycling of slurry through a trough system to process the wet solids phase. This process may further increase the efficiency of the system, while producing cleaner drilling fluids for recycling into the well bore.

Also advantageously, embodiments disclosed herein may allow for a modularized drilling waste management system that may be transported and installed on drill rigs with relative ease. Because of the system's modularity, the entire separatory operation may be maintained within a support structure, installed on an offshore rig, then uninstalled when the offshore rig must be moved. As such, the modularity of the system may provide a solution to bulky systems of existing rigs, especially tender-assist and other mobile drill rigs. Furthermore, because the system may be modular and substantially self-contained, systems in accordance with the present disclosure may be retrofitted onto existing rigs. Such retrofitting operations may further increase the cuttings processing and drilling efficiency of offshore rigs. The modularity and retrofitting aspects of the present disclosure may further provide the advantage of faster methods for rigging up and manipulating aspects of drilling waste management.

Finally embodiments disclosed herein may take advantage of high efficiency vibratory separator operations employing fine mesh filtering elements. Because of the effectiveness of such vibratory separators, the dual-trough system disclosed herein may provide for a faster process of conveying solid materials and slurries used or produced in drilling operations.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A system comprising:

a flow line configured to provide a return flow of drilling fluids;

at least one vibratory separator having a scalping deck and a fines deck, wherein the vibratory separator is fluidly connected to the flow line and configured to receive at least a partial flow of the fluids and separate the flow of fluids into a primarily fluid phase and a primarily solids phase, the scalping deck being upstream of the fines deck;

a dual-trough configured to receive the primarily solid phase from the at least one vibratory separator, the dual-trough comprising a first trough partition configured to receive the solid phase from the scalping deck of the vibratory separator; and a second trough partition configured to receive the solid phase from the fines deck of the vibratory separator, the dual-trough further comprising at least one divider panel configured to divert the solids between the first trough partition and the second trough partition; and a slurry tank configured to receive the solid phase from the trough.

2. The system of claim 1, further comprising:

at least one centrifuge fluidly connected to the slurry tank.

3. The system of claim 2, wherein the at least one centrifuge is disposed on a transport vessel.

4. The system of claim 2, further comprising:

a slurry pump configured to pump the slurry in the slurry tank to the at least one centrifuge.

5. The system of claim 1, further comprising:

a circulation pump configured to provide a fluid to the trough.

6. The system of claim 4, wherein the circulation pump substantially continuously circulates the fluid into the trough.

7. The system of claim 1, further comprising:

a distributor box configured to receive the return flow of drilling fluids from the flow line.

8. The system of claim 1, wherein the scalping deck comprises:

a filtering element having less than 75 micron perforations.

9. The system of claim 1, wherein at least one of the flow line, the at least one vibratory separator, the dual-trough, and the slurry tanks are disposed in a support structure.

10. The system of claim 9, wherein the support structure comprises a transportable module.

11. The system of claim 1, wherein the dual trough and slurry tank comprise a modular system.

12. The system of claim 11, wherein the modular system further comprises at least one of a centrifuge, a vibratory separator, a slurry pump, a circulation pump, a distributor box, a divider panel, and a filtering element.

13. The system of claim 11, wherein the modular system is configured to receive a flow of drilling fluids from a primary separator underflow.

* * * * *